US007524079B2

(12) United States Patent
Greenhoe

(10) Patent No.: US 7,524,079 B2
(45) Date of Patent: Apr. 28, 2009

(54) SOLAR RECHARGEABLE LANTERN

(76) Inventor: William John Greenhoe, 8450 W. Hibbard Rd., Ovid, MI (US) 48866

( * ) Notice: Subject to any disclaimer, the term of this patent is extended or adjusted under 35 U.S.C. 154(b) by 0 days.

(21) Appl. No.: 11/474,077

(22) Filed: Jun. 23, 2006

(65) Prior Publication Data

US 2007/0297167 A1 Dec. 27, 2007

(51) Int. Cl.
*F21L 4/00* (2006.01)

(52) U.S. Cl. ..... 362/183; 362/800

(58) Field of Classification Search ..... 362/183
See application file for complete search history.

(56) References Cited

U.S. PATENT DOCUMENTS 4,004,132 A * 1/1977 Glass et al. ..... 362/186
5,221,891 A * 6/1993 Janda et al. ..... 323/350
6,290,367 B1 * 9/2001 Greenhoe et al. ..... 362/183
6,305,185 B1 * 10/2001 Sloan ..... 62/457.7
2006/0098437 A1 * 5/2006 Yuen ..... 362/287
2006/0208695 A1 * 9/2006 Weinstein et al. ..... 320/110
2007/0013340 A1 * 1/2007 Mattichak ..... 320/101

* cited by examiner

*Primary Examiner*—Jong-Suk (James) Lee
*Assistant Examiner*—Julie A Shallenberger
(74) *Attorney, Agent, or Firm*—Barnes & Thornburg LLP

(57) ABSTRACT

A solar rechargeable lantern assembly is disclosed. The solar rechargeable lantern assembly includes at least one light source, a battery electrically connected to the at least one light source suitable for providing power to at least one of the at least one light source and at least one an external load, and a solar panel electrically connected to at least one of the at least one light source and the battery by a connector suitable for releasably coupling the electrical connection between the solar panel and at least one of the at least one light source, the battery, and at least one external load suitable for providing power to at least one of the at least one light source, the battery, and at least one external load, wherein the electrical connection includes a switch suitable for interrupting power to at least one of the at least one light source, the battery, and at least one external load when the battery reaches a threshold.

19 Claims, 6 Drawing Sheets

SOLAR RECHARGEABLE LANTERN

FIELD OF THE INVENTION

The present invention relates to light sources, particularly to lanterns, and more particularly, to a solar rechargeable lantern.

BACKGROUND OF THE INVENTION

Battery-powered lanterns are well known and are used worldwide as portable light sources in a wide variety of work and leisure activities, including many activities in remote areas. Such lanterns typically include a base and a fixture mounted on the base. One or more light sources are supported within the fixture, and a battery contained within the base powers the one or more light sources.

As with all battery-powered devices, battery life is a concern. Without a battery tester, determining the remaining life of a battery is difficult. To avoid running out of power, a user either will replace batteries before they are fully used or will carry extra batteries. Early replacement of batteries produces unnecessary waste and expense. Particularly in remote areas, extra batteries fill needed space and add weight, or may be hard to procure.

Solar-powered lanterns are used, in part, to eliminate the need to replace batteries, the need to carry extra batteries, and to generally extend battery lifetimes. Solar-powered lanterns often include a rechargeable battery in a base and a separate solar panel that may be connected to the lantern to recharge the battery. Unfortunately, solar-powered lanterns also suffer several disadvantages. First, continued full discharge of the battery shortens the life of the battery. Second, full discharge degrades the battery, causing the battery to hold less charge each cycle. Third, the lights within the solar lanterns oscillate or flicker when the battery is weak.

Additionally, external power to drive other devices may be hard to find in an environment where a solar-powered lantern is being used, such as at a remote campsite. It would be convenient if a source to power externals loads, such as a small electronic device, including, but not limited to, a radio, television, cellular telephone, or an electric razor, could be provided within those devices already be used.

Thus, a need exists for a solar rechargeable lantern that disconnects power to the light source and external load when the battery voltage falls below an acceptable level thereby preventing full discharge. Also, a need exists for a solar rechargeable lantern with a more energy efficient light source than a standard light bulb. Additionally, a need exists for a solar rechargeable lantern that may emit light, running solely on electricity provided by the solar panel, thus eliminating the need for waiting for the battery to be charged before using the lantern.

SUMMARY OF THE INVENTION

A solar rechargeable lantern assembly, including at least one light source; a battery electrically connected to the at least one light source suitable for providing power to at least one of the at least one light source and at least one an external load; and, a solar panel electrically connected to at least one of the at least one light source and the battery by a connector suitable for releasably coupling the electrical connection between the solar panel and at least one of the at least one light source, the battery, and at least one external load suitable for providing power to at least one of the at least one light source, the battery, and at least one external load, wherein the electrical connection includes a switch suitable for interrupting power to at least one of the at least one light source, the battery, and at least one external load when the battery reaches a threshold.

An electrical power assembly, including a solar panel electrically connected to at least one of the at least one light source and the battery by a connector suitable for releasably coupling the electrical connection between the solar panel and at least one of the at least one light source, the battery, and at least one external load suitable for providing power to at least one of the at least one light source, the battery, and at least one external load, wherein the electrical connection includes a switch suitable for interrupting power to at least one of the at least one light source, the battery, and at least one external load when the battery reaches a threshold.

A method for making an electrical power assembly, the method including providing a solar panel electrically connected to at least one of the at least one light source and the battery by a connector suitable for releasably coupling the electrical connection between the solar panel and at least one of the at least one light source, the battery, and at least one external load suitable for providing power to at least one of the at least one light source, the battery, and at least one external load, wherein the electrical connection includes a switch suitable for interrupting power to at least one of the at least one light source, the battery, and at least one external load when the battery reaches a threshold.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for the purpose of clarity, many other elements found in typical solar rechargeable lanterns. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Figure 1A:
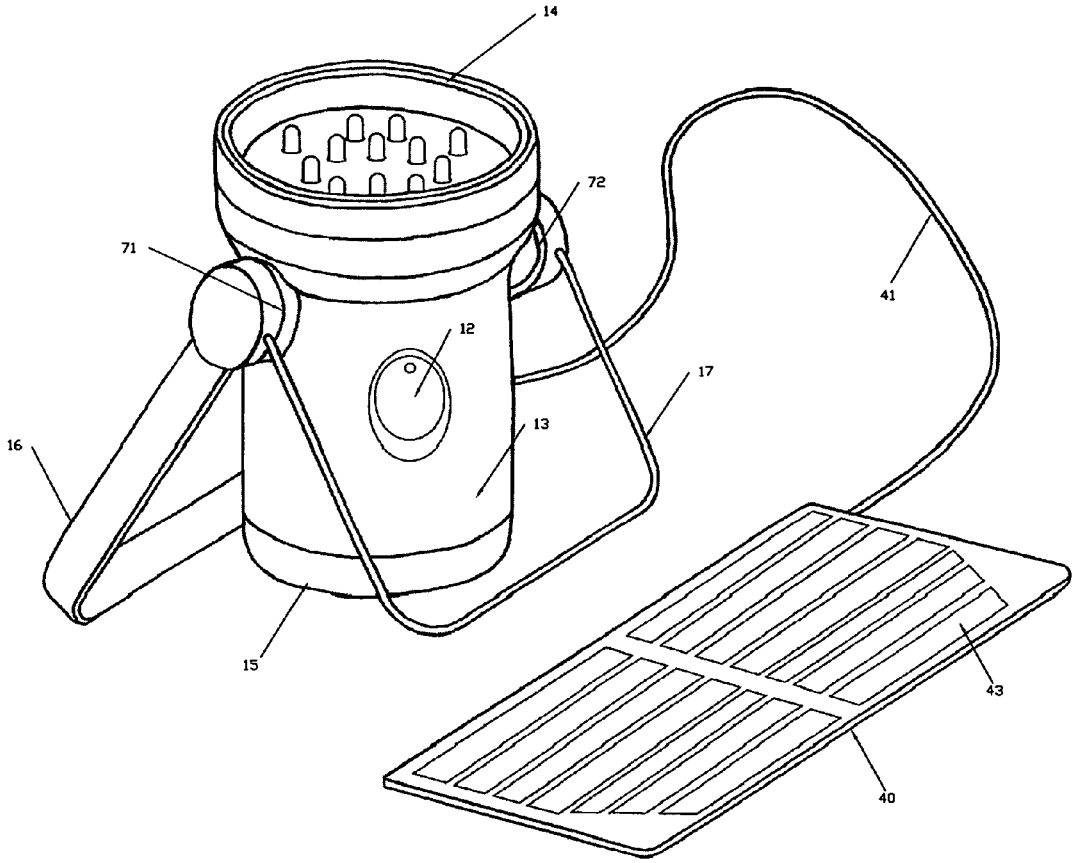
FIG. 1A illustrates a perspective view of the lantern according to an aspect of the present invention.

Referring now to FIG. 1A, there is shown a perspective view of the lantern according to an aspect of the present invention. As may be seen in FIG. 1A, a lantern assembly 1 may include a lantern 10, a housing 13, a cap 14, a base 15, a carrying handle 16, a stand 17, a socket 32, and pivot points 71 and 72. Lantern assembly 1 may further include a solar panel 40, a cord 41, and a plug 42. Base 15 may be coupled to housing 13, which may be, in turn, coupled to cap 14. Carrying handle 16 may be coupled to housing 13 at pivot points 71 and 72 to allow a user to carry lantern 10 using carrying handle 16 and such that a user may change the direction of the light output from cap 14. Carrying handle 16 and stand 17 may be positioned at opposite sides of base 15, increasing the stability of lantern 10. Stand 17 may be movably coupled to carrying handle 16 substantially adjacent to pivot points 71 and 72, or it may be coupled to carrying handle 16 near pivot points 71 and 72, close enough to allow for increased stability of lantern 10 when stand 17 and carrying handle 16 are positioned at opposite sides of base 15. Stand 17 may retract into carrying handle 16 to allow easily grasping and transporting lantern 10. Socket 32 may be mounted within housing 13 to releasably connect plug 42. Solar panel 40 may be coupled to cord 41, which may in turn be coupled to plug 42. Solar panel 40 may include a plurality of individual solar panel elements 43.

Figure 1B:
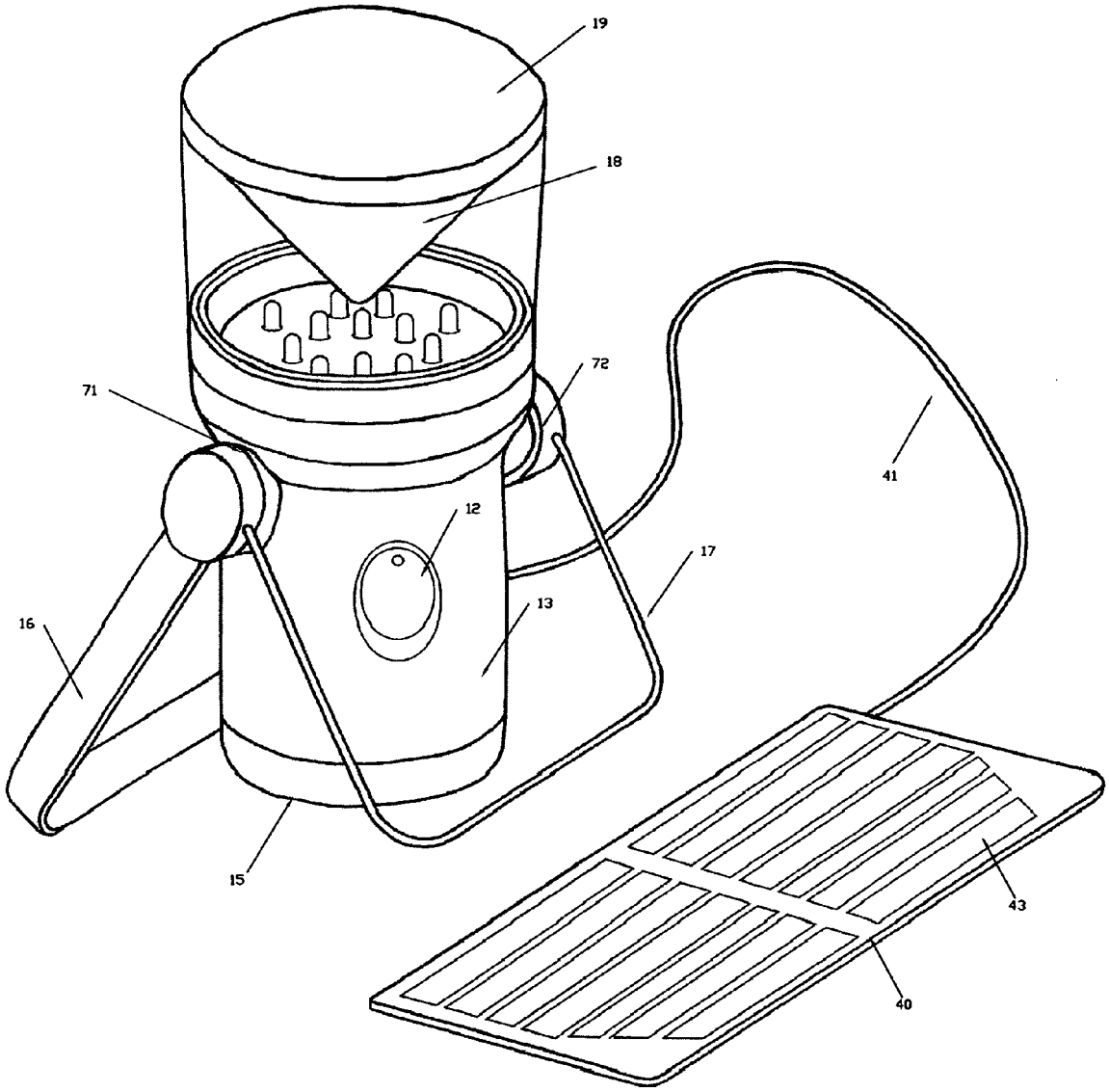
FIG. 1B illustrates a perspective view of the lantern according to an aspect of the present invention.

Referring now to FIG. 1B, there is shown an illustration of the lantern according to an aspect of the present invention. As may be seen in FIG. 1B, FIG. 1B is a modification of FIG. 1A that shows the lantern in flashlight mode as opposed to lantern mode. In FIG. 1B, there is additionally a reflector assembly 18 and a cap 19. Reflector assembly 18 is designed to direct the light in a similar fashion to a flashlight. The cap 19 and reflector assembly 18 may be unscrewed from lantern 10 to radiate light axially like a flashlight.

Lantern 10 may take any of a numerous shapes and be of any size or weight. The only limitation on the size, shape, and weight are determined by the overall design for use in remote locations, for example. Further, the interrelation of the various components and ability of the components to fit together may also be a limitation. For example, the size of the handle 16 may be somewhat determined by the size of the other elements of lantern 10, including but not limited to the overall weight of the lantern assembly 1. As would be evident to those possessing an ordinary skill in the pertinent arts, handle 16 must be capable of supporting and being used to carry lantern 10. The brightness and power of the light emitted by lantern 10 may only be sufficient to provide reading light for the inside of a camping tent, or it may be sufficient to provide light for work at a construction site. The brightness of lantern 10 may also be of the variable variety allowing for brightness controls and thereby a control over the amount of power used by lantern 10. The brightness and power of the light emitted by lantern 10 may also be of other levels known to those possessing an ordinary skill in the pertinent art. The wavelength of the light emitted by lantern 10 may range throughout the visible spectrum, as well as in the infrared or ultraviolet spectrum. The light output may approximate a blackbody radiation source or be discrete wavelengths or sets thereof. As may be evident to those possessing an ordinary skill in the pertinent arts, the type of lamp 130 used may be determinative of the output spectra of lantern 10. Often an indium lamp produces a yellow hued output while hydrogen type lamps produce bright blue outputs. The output may take the form of a source in between multiple types described hereinabove. Lantern 10 may be used in a variety of situations, including but not limited to lighting for outdoor activities such as camping, lighting for construction of a building, and lighting for indoor use, such as in a residence. By way of non-limiting example only, construction lights utilize 200-500 watts per light and there are multiple lights sources. The sources used in lanterns/flashlights use between 3-5 watts, florescent lights utilize between 4-7 watts, and the halogen is 7+ watts. The present invention produces equivalent or better light with an LED cluster and consumes approximately 1-1.5 watts.

Housing 13 may be constructed from any material, including but not limited to metal, plastic, ceramic, or glass. As would be evident to those possessing an ordinary skill in the pertinent arts, the selection of construction material may have an effect on the functionality of lantern 10 including but not limited to durability and weight, for example. Housing 13 may have a variety of dimensions and may be of any thickness, any height, and any diameter. Housing 13 may be solid or permeable, depending on the need for heat dissipation from inside lantern 10.

Housing 13 may be coupled to base 15 and cap 14 in a variety of ways. The coupling may take the form of a detachable or permanent coupling, depending upon whether the light source and battery may eventually need to be replaced, or whether the useful lives of the light source and battery exceed the life of the lantern. The coupling may take many forms, including, but not limited to, screw-on, snap-together, latch, hook and loop, or coupled with the use of screws, rivets, for example, or other fasteners that are known in the art. The coupling may also combine some or all of the above forms. Housing 13 may be of a light weight or density if there is a need for it to be easily moved or float in water, for example, or housing 13 may be of a heavy weight or density if there is a need for it to remain stable, or in a single position for a long period of time. Intermediate weights may also be used to produce lanterns that have some attributes of light and heavy lanterns. Housing 13 may include a finish of many types, including, but not limited to, varnish, paint, laminate, or a label that may contain information. Further, housing may be oxidized, or provided with another suitable covering to increase the durability and strength of housing 13. Combinations of finishes may also be used. Housing 13 may also be embossed with information. Housing 13 may have one or many holes formed or drilled in it that may allow for accommodation of one or more sockets, carrying handles, or other coupled items.

Cap 14 may be of any size, weight, material, or translucency. Cap 14 may screw onto housing 13, or it may be coupled to housing 13 in other ways, including, but not limited to, snapping or latching. Cap 14 may be coupled to housing 13 in a removable or permanent fashion, or may be attached removable in a somewhat permanent fashion, such as using threads with glue, for example. Cap 14 may be made from a material that is transparent, translucent, or opaque to the eye or at the wavelengths lamp 130 emits. The choice of material may affect the amount of light passing through as would be evident to those possessing an ordinary skill in the pertinent arts. The translucency may be of any degree, ranging from complete transparency to completely opaque.

Base 15 may be of any size, weight, or material limited as described hereinabove. Base 15 may have a rubberized or other non-skid, or a protective coating, such as anodization on the bottom outer surface or substantially completely covering bases. The coating may be of any material, including, but not limited to, rubber, plastic, or other materials known to those possessing an ordinary skill in the pertinent art. Base 15 may also have feet or other supports to prevent skidding or tipping of lantern 10. The feet or other supports may be of any size or material, including but not limited to rubber, plastic, or metal. The feet may also be made of a durable material with a material pad on the end in order to protect and prevent slippage, such as for example, rubber, felt or other padding material, for example. Base 15 may have any number of feet or other supports. As would be evident to those possessing an ordinary skill in the pertinent arts, for stability it is preferable to include three or more feet, although less than three feet may also be utilized. The feet or other supports may be attached to base 15 in any manner, including, but not limited to, adhesive, screw-on, snap-on, or rivets. The feet or other supports may be a ring with three supports linking the ring to the bottom of base 15. The feet or other supports may be of any other number, material, or attachment manner known to those possessing an ordinary skill in the pertinent art.

Housing 13, cap 14, and base 15 may be of similar or different size, weight, or material as described hereinabove. Base 15 may be larger, heavier, or of a more dense material than housing 13 and cap 14 if there is a need for increased stability of lantern 10. Base 15 may be made of a less electrically conductive material than housing 13 and cap 14, in order to protect lantern 10 from static electricity, such as if lantern 10 is to be used in an environment where static electricity is present on the ground. Base 15 may be larger than housing 13 or cap 14 if there is a need to have a larger capacity battery inside base 15.

Carrying handle 16 may be of any size, weight, or material and limited only as described hereinabove. Carrying handle 16 may be generally shaped like a "U," but may also take the form of an "L" with one pivot, or it may be formed in any other shape to allow carrying of lantern 10. Carrying handle 16 may be coupled to housing 13 via pivot points 71 and 72. Carrying handle 16 may be movably or immovably coupled to housing 13 with rivets, screws, or any other attachment manner known to those possessing an ordinary skill in the pertinent art. Carrying handle 16 may be removable from housing 13 to allow for fitting the lantern into a discrete receiver, such removing including, but not limited to, snap-off, slide-off, clamps, or another attachment manner known to those possessing an ordinary skill in the pertinent art Stand 17 may be of any size, weight, thickness, or material and may unite with other parts of lantern assembly 1 as described hereinabove. Stand 17 may be coupled to handle 16 at pivot points 71 and 72. Stand 17 may be positioned so that it touches the ground or other surface on which the bottom of base 15 is positioned. Stand 17 may increase the stability of lantern 10 by touching the ground or other surface on the side of base 15 opposite that where handle 16 touches the ground or other surface. Stand 17 may be retractable into handle 16 when lantern 10 is being carried, or it may be coupled to housing 13 at pivot points 71 and 72, independent of handle 16. Stand 17 may be made of any material, including but not limited to metal, plastic, ceramic, or glass. Stand 17 may be solid or hollow. Stand 17 may be coated with rubber, plastic, or any other material to provide better anti-skid and non-marring performance. Stand may also be formed such that it provides lantern 10 an electrical ground connection or may be formed to provide ground isolation.

Socket 32 may be mounted within housing 13 to allow the releasable connection of plug 42 or an external load. Socket 32 may be of any size, shape, or material, depending on the size, shape, or material of plug 42 or an external load plug. Socket 32 may also be externally made of a low electrical conductivity material to prevent the user from receiving an electric shock when connecting plug 42 or an external load plug. A plurality of sockets 32 may be provided to allow for simultaneous input and output of energy, such as allowing for multiple inputs and outputs as desired. The discussion herein and the associated figures focus the discussion on one socket for simplicity while knowing that multiple sockets may be used.

Socket 32 may be located at any position within housing 13, within base 15, or within cap 14, depending upon the optimal ergonomic place, factoring in other considerations as would be evident to those possessing an ordinary skill in the pertinent arts, for a user to reach socket 32 when inserting plug 42 or an external load plug, and depending upon the available space inside lantern 10 to connect socket 32 to other internal components.

Solar panel 40 may be of any type, size, shape, or power generation capability, depending upon several factors, including, but not limited to, the desired power requirements of lantern 10, the cost of solar panel 40, the weight and durability of solar panel 40, and the aesthetic qualities of solar panel 40. Solar panel 40 may include a plurality of individual solar panel elements 43 or may be one solar panel element 43. Solar panel 40 may be coupled to lantern 10 via socket 32. A plurality of solar panels 40 each including a plurality of individual solar panel elements 43 or including a single solar panel element 43 or a combination thereof, may also be used. The discussion herein and the associated figures focus on a single panel 40 for simplicity and clarity, while including the use of multiple panels therein. Solar panels 40 may couple to lantern 10 via a single socket 32 or via plurality of sockets 32. Solar panel 40 may be of power generation capability sufficient to allow lantern 10 to provide light, or may have extra power generation capability to recharge battery 30 while providing light or it may have extra power generation capability sufficient to power lantern 10 for lighting and an external load and may also include recharging battery 30. As is known to those possessing an ordinary skill in the pertinent art, but recited for completeness, solar panel 40 may provide power to lantern 10 by receiving photons from the sun, which strike individual solar panel elements 43. Solar panel 40 may convert the photons to electrons. These electrons may be conducted via cord 41 to provide power to the light source, battery, or external load as described hereinabove.

Cord 41 may be of any length, material, or diameter, depending on how much power needs to be carried per second from solar panel 40 to lantern 10, how far away solar panel 40 may be from lantern 10, and the desired cost of cord 41. Cord 41 may contain a single strand of conductive material, such as wire, or it may contain a plurality of conductive strands or wires. Cord 41 may have an external surface made of rubber, plastic, metal, or fabric, or any other material. As would be evident to those possessing an ordinary skill in the art, cord may be covered with a nonconductive, or insolating, material in order to provide electrical isolation. A plurality of cords may also be used. By way of non-limiting example only, cord 41 may have two wires (positive and negative) each stranded, such as a multiple 32 AWG wire to make up a larger gauge wire, like 18-24 AWG for example, with no ground. According to this aspect of the present invention, as would be evident to those of ordinary skill in the pertinent arts, using stranded wire improves conductivity and flexibility, as compared to solid wire which is rigid and has a memory, such that when bent the wire stays in that shape.

Plug 42 may be of any size, shape, or material and is limited functionally as described hereinabove. Plug 42 may be removably coupled to socket 32 in any manner, including but not limited to screwing on, snapping on, or a press fit. Plug may take the form of any plug known to those possessing an ordinary skill in the pertinent arts. Plug 42 may be used to connect solar panel 40 and cord 41 to lantern 10 so that lantern 10 may receive power collected by solar panel 40.

Pivot points 71 and 72 may be of any diameter and any material. Two pivot points 71 and 72 are discussed and shown herein, for simplicity of discussion, while knowing that there may be more than two pivot points, or there may be only one pivot point. Pivot points 71 and 72 may allow 360 degrees of rotation. Pivot points 71 and 72 may be coupled to housing 13, or they may be coupled to base 15 or cap 14, in any manner, including, but not limited to, attachment via rivets, screws, snap-on, or any other manner known to those possessing an ordinary skill in the pertinent art. Pivot points 71 and 72 may be stiff or freely moving, affected by the coupling mechanism chosen. Pivot points 71 and 72 may move in a cam-type continuous arc, or it may have fixed interval positions capability, which may be achieved using one or more tongues protruding from housing 13 and several notches, one at each desired stopping point in the motion arc, carved out of pivot points 71 and 72.

According to an aspect of the present invention, lantern assembly 1 may include a lantern 10 assembled by creating a base 15 from PVC, in a circular bowl shape, with a diameter of approximately 3 inches, a height of approximately 1 inch, and a wall thickness of approximately 0.5 inches. For example, lantern 10 may have an overall height of approximately 5.5 inches which extends to approximately 6.8 inches with the handle straight up. The overall flashlight height may be approximately 3.6 inches, by way of non-limiting example only. Housing 13 may be created from PVC, in a cylindrical shape, with a diameter substantially similar to that of base 15, a height of approximately 3 inches, and a wall thickness substantially similar to that of base 15. Housing 13 may be coupled to base 15 by a screw on connection. Cap 14 may be created from PVC, it is substantially transparent, in a circular bowl shape, substantially similar to that of housing 13, a height of approximately 0.5 inches, and a wall thickness of approximately 0.1 inches. Cap 14 is coupled to housing 13 by a screw on connection.

By way of non-limiting example only, reflector assembly 18 may be formed in a conical shape and have a diameter of approximately 2.6 inches and a height of approximately 1.5 inches. Cap 19 may have a diameter of approximately 3 inches with a height of approximately 0.5 inches. The lens may have a diameter of approximately 2.7 inches with a height of 2 inches. Cap 19 and the lens may together have a diameter of approximately 3 inches and a height of 2.2 inches.

Carrying handle 16 is created from PVC, in a "U" shape, with a handle width of approximately 0.75 inches, a thickness of approximately 0.2 inches, a total length of approximately 4 inches, a center portion length of approximately 4 inches with the two side portions having a length substantially similar to each other of approximately 4-4.5 inches. Carrying handle 16 may be coupled to housing 13 at pivot points 71 and 72 by pressure. Stand 17 may be created from a metal, in a tubular shape, with the tube diameter of approximately 0.14 inches, in a "U" shape, with total length and the length of the portions substantially similar to that of carrying handle 16. Stand 17 may be coupled to carrying handle 16 and housing 13 at pivot points 71 and 72 by pressure.

Socket 32 may be of a type such as that known in the art as 2.5 mm×5.5 mm DC Power Jack. Socket 32 may be coupled to housing 13 at a point approximately 1.0 inches from the bottom edge, at a horizontal position substantially at the middle between pivot points 71 and 72 by a screw on panel mount jack, for example. The hole in housing 13 to accommodate the coupling of socket 32 may be a round hole of 0.3 inches in diameter. A switch 12 may be mounted within the housing to provide a means of turning on and off the LED driver circuit 55. Switch 12 may take the form of a two-position switch. Terminal 300 of the switch 12 may be connected to the positive of battery 30 and the terminal 301 of the switch 12 is connected to the source 292 of the switch 190 of the LED driver circuit 55. Terminal 302 of the switch 12 may be connected to the anode of LED 141 and the terminal 303 of switch 12 is connected to the anode of LED 144. Switch 12 may be coupled to housing 13 at a point approximately 1.0 inch from the bottom edge, at a horizontal position substantially at the middle between pivot points 71 and 72 on the opposite side of socket 32.

According to an aspect of the present invention, the solar panel 40 may be formed from polycrystalline. There may be 18 cells each with a surface area of approximately 0.52 square inches, while the individual cells may be different shapes, and overall panel size of approximately 3.9×5.3×0.1 inches. The power output may be rated at approximately 0.76 watts at 8.1 volts. Cable may be a 2-conductor 18 AWG insulated wire that is approximately 72 inches in length with an epoxy potted big tail at the panel and a molded 2.5×5.5×9.5 mm barrel DC power Jack.

Pivot points 71 and 72 are created from PVC, in a round shape, with a diameter of approximately 1 inch. Pivot points 71 and 72 are located at substantially opposite locations on either side of housing 13. Pivot points 71 and 72 are coupled to housing 13 by pressure.

Molded onto the sides of housing 13 may be two approximately 1 inch outer diameter cylinders each with a 0.8 inch inner diameter cavity that is 0.16-inch deep and twelve 0.15-inch diameter half-round groves on the face of the cavity. Each grove may start at the outside of the cavity and goes to the center, such as if the marks on a clock were extended to the center. Handle 16 has two 1.0-inch diameter ends (one on each end of the "U") with a 0.8 inch outer diameter cylinders that may be 0.16 tall with a 0.15-inch diameter half-round bump on the face of the 0.8 inch cylinders that extends from one edge of the face through the center and to the opposite edge. The outer diameter width on the housing 13 from one of the 1.0-inch cylinders to the other may be approximately 4.0 inches. The inner diameter width on handle 16 from one of the 1.0-inch cylinders to the other is approximately 3.8 inches. The 0.8" cylinders on handle 16 insert into the 0.8" diameter cavities of Housing 13 and are held in place by pressure. The 0.15" diameter bumps on handle 16 seat into opposite 0.15" diameter groves on housing 13. As you rotate the handle 16, the bumps move to the next set of grove in the Housing, moving the handle 30°, by way of non-limiting example only.

Stand 17 may be made in the same "U" shape as handle 16 with the ends of stand 17 bent inwards toward each other by approximately 0.5". The ends of stand 17 may be inserted into the center of 0.8" cylinders of handle 16. Handle 16 may provide openings for stand 17 to swing from fully retracted into handle 16 to 60° away from handle 16, by way of non-limiting example only. On each end of the openings there may be 0.15" half-round groves to enable stand 17 to lock into the fully retracted position or fully open position. This may be accomplished by pressure.

Figure 2:
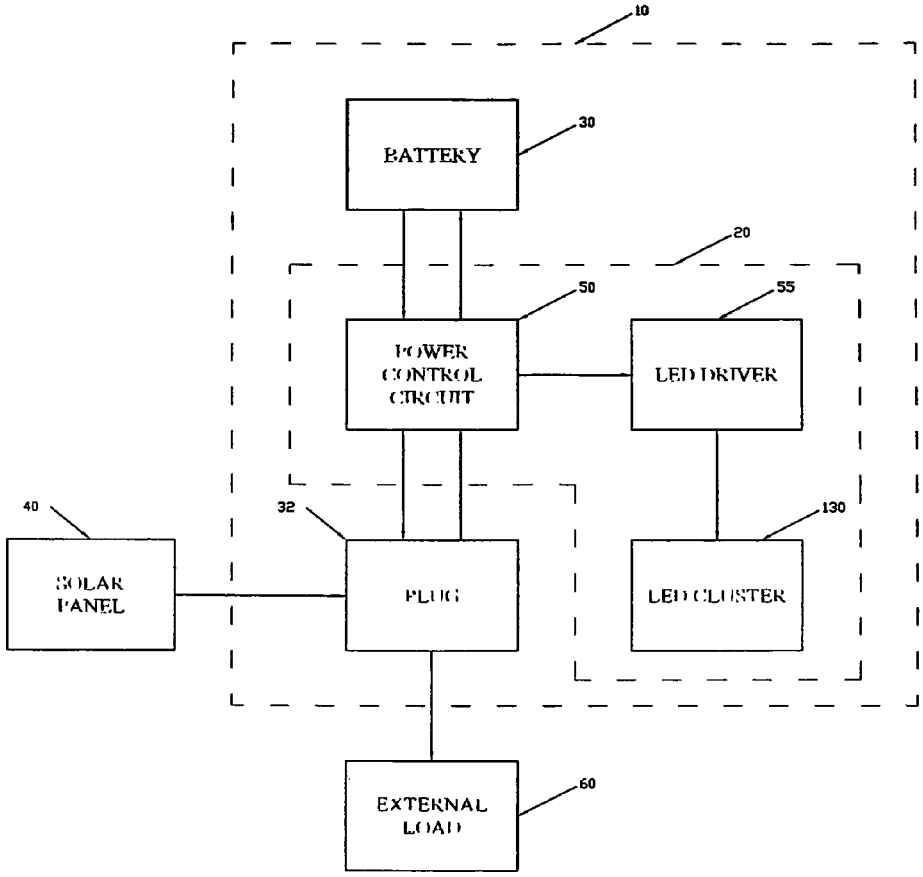
FIG. 2 illustrates a block diagram of the lantern according to an aspect of the present invention.

Referring now to FIG. 2, there is shown a block diagram of the lantern according to an aspect of the present invention. As may be seen in FIG. 2, lantern 10 may include a circuit board 20, a battery 30, a socket 32, a solar panel 40, a power control circuit 50, an external load 60, and an LED cluster 130. LED cluster 130 may receive power via a connection to power control circuit 50. Both or either of LED cluster 130 and power control circuit 50 may be mounted to circuit board 20. Battery 30 may be connected to power control circuit 50. Socket 32 may be connected to power control circuit 50.

Socket 32 may receive power via a connection to solar panel 40. External load 60 may receive power via a connection to socket 32.

Battery 30 may be any rechargeable battery, including, but not limited to, a nickel-metal hydride (NiMH) battery, a nickel cadmium battery, or any other rechargeable battery known to those possessing an ordinary skill in the pertinent art. Battery 30 may be of any capacity or voltage, depending on the power requirements of LED cluster 130 or external load 60. Battery 30 may be designed to be able to power lantern 10 for any amount of time, and the potential times may depend on the power requirements of LED cluster 130 or external load 60. Battery 30 may also be able to contemporaneously permit lantern 10 to emit light via LED cluster 130 and provide power for external load 60. A plurality of batteries 30 may be used to provide power for LED cluster 130 and external load 60, depending on the cost, weight, and physical shape of lantern 10. One battery 30 is discussed herein for simplicity while multiple or a plurality of batteries 30 may also be utilized.

Solar panel 40 may be releasably connected to socket 32 to charge battery 30, to supply power to LED cluster 130, and to supply power to external load 60.

Power control circuit 50 may control the supply of power to LED cluster 130 or external load 60. Power control circuit 50 may prevent battery 30 from being drawn below an unacceptably low voltage. An unacceptably low battery voltage may be about 10 volts or less. An unacceptably low battery voltage may be about 5% or less state of charge (SOC) or 95% or more depth of discharge (DOD). Voltage termination may be calculated by the formulas:

For 1-10 cells—Number of cells times 1.0 Volts

For 11-20 cells—(Number of cells−1) times 1.1 volts

The number of cells in the present aspect of the invention is 10, so the termination was set at 10.0 volts, nevertheless, a termination between 9-10.5 volts would be acceptable with little change in runtime, as would be evident to those possessing an ordinary skill in the pertinent arts.

LED cluster 130 may be any light source and is referred as LED cluster for simplicity. LED cluster 130 may be a light bulb, LED cluster, halogen lamp, or any other light generation device known to those possessing an ordinary skill in the pertinent art. LED cluster 130 may consist of any brightness LEDs with multiple LEDs connected in series with a resistor with multiple strings connected in parallel. The brightness configuration used may be able to control the brightness curve output from lantern 10. This configuration is of a conventional design generally known to those skilled in the art. LED cluster 130 may consist of any combination of colored LEDs. The colors emitted by the LEDs may include, but are not limited to, white, yellow, red, and blue, depending on the anticipated environment in which lantern 10 will operate. Multiple colors may be used, such as to provide a blackbody source, for example. The wavelength of the light emitted by the LEDs may range throughout the visible spectrum, as well as in the infrared or ultraviolet spectrum. The light output may approximate a blackbody radiation source or be discrete wavelengths or sets thereof. The output may take the form of a source in between the types above and may include multiple of the varieties described hereinabove. The LEDs may be of any number, including a single LED or a plurality of LEDs as shown. The LEDs may be arranged in any two-dimensional or three-dimensional geometric configuration, including but not limited to a circular pattern, a square grid, a rectangular grid, a star pattern, a cube or a sphere, by way of non-limiting example only. There may be a plurality of LED clusters 130. LED cluster 130 may be of any brightness. The individual LEDs, which make up LED cluster 130, if in fact more than one LED is utilized, may be of any brightness.

Figure 3:
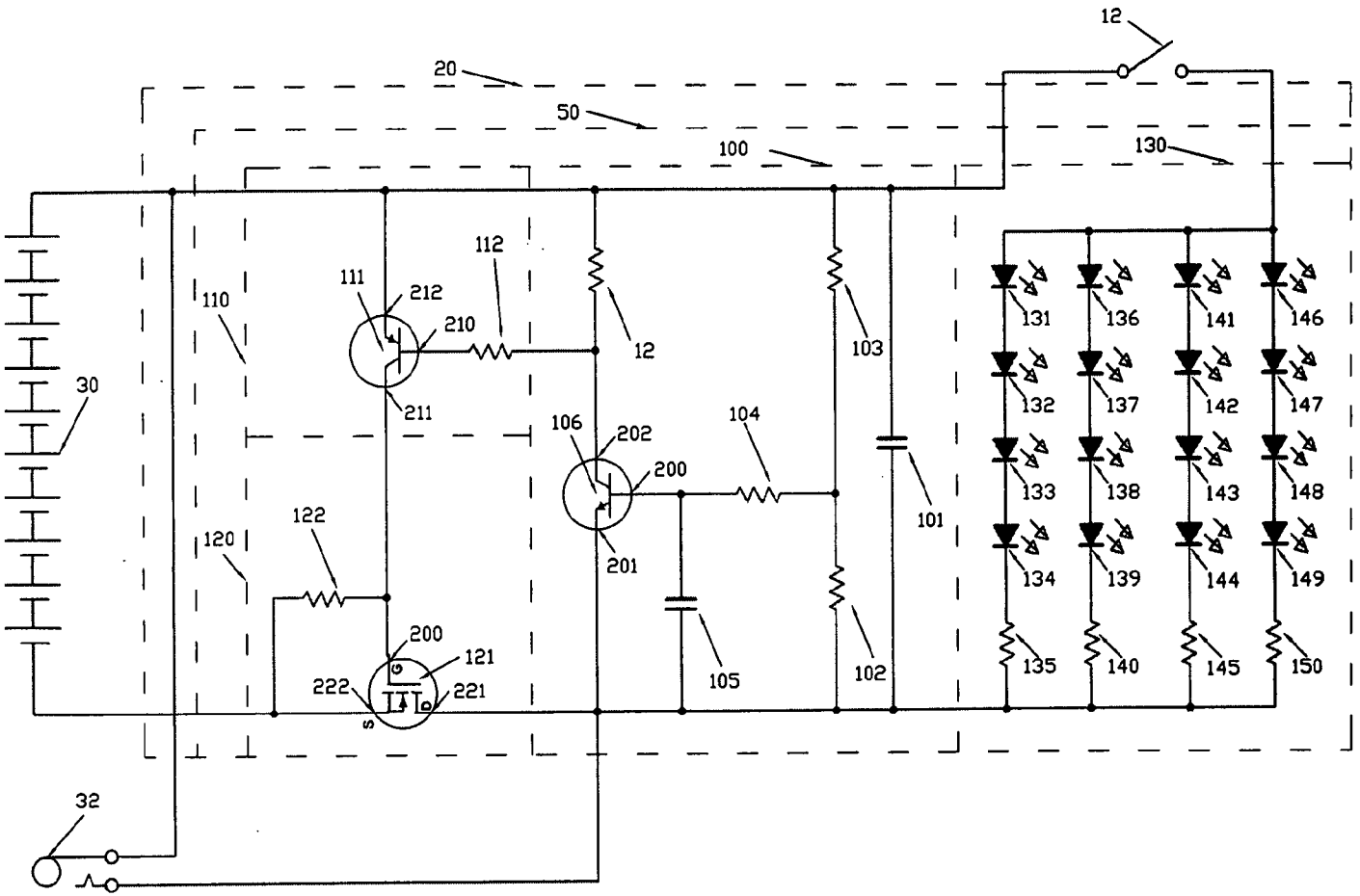
FIG. 3 illustrates a schematic circuit diagram of the power control circuit of the lantern according to an aspect of the present invention.

Referring now to FIG. 3, there is shown a schematic circuit diagram of the power control circuit of the lantern according to an aspect of the present invention. As may be seen in FIG. 3, circuit board 20 may hold a power control circuit 50 and an LED cluster 130. Power control circuit 50 may include shutdown 100, level shifter 110, disconnect 120, and LED cluster 130. Power control circuit 50 is connected to switch 12, battery 30, and socket 32. Power control circuit 50 may be connected to other switches, batteries, or sockets. Shutdown 100 may set the value of the threshold governing when battery power output is terminated. Level shifter 110 may reduce the voltage input to Disconnect 120 to zero when the battery-power-termination threshold is reached. Disconnect 120 may stop the flow of electricity from battery 30 to LED cluster 130 and external load 60.

Shutdown 100 may control when battery power output is terminated. Shutdown 100 may work to shutdown all battery power output or to selectively shutdown the output to one of or all of the plurality of external loads, or to the light source. Shutdown 100 may contain a 24.9 kΩ resistor 102 in series with a 532 kΩ resistor 103. The level of resistance in these two serial resistors may determine the battery voltage below which the power output is terminated. Resistors 102 and 103 may comprise a voltage divider configuration. Other resistors and configurations may be used as would be evident to those possessing an ordinary skill in the pertinent arts. The values of the resistors may be selected depending on the desired cut-off battery voltage. A 0.1 μF capacitor 101 may be connected in parallel with voltage divider resistors 102 and 103. Interconnected between resistors 102 and 103 may be a 100 kΩ resistor 104 leading to base terminal 200 of NPN shutdown transistor 106. Emitter terminal 201 of shutdown transistor 106 may be connected to drain 221 on disconnect transistor 121. Disconnect transistor 121 may be a metal-oxide semiconductor field-effect transistor (MOSFET). A 0.1 μF capacitor 105 may be connected in parallel between base terminal 200 of shutdown transistor 106 and drain 221 of disconnect transistor 121. A 750 kΩ resistor 107 may be connected between collector terminal 202 of shutdown transistor 106 and the positive of battery 30. Shutdown 100 may control level shifter 110.

Level shifter 110 may connect with shutdown 100 via a 100 kΩ resistor 112 to collector terminal 202 of shutdown transistor 106 and base terminal 210 of PNP level shifter transistor 111. Emitter 212 of level shifter transistor 111 may be connected to the positive of battery 30. Level shifter 110 may be controlled by shutdown 100. Level shifter 110 may control disconnect 120.

Disconnect 120 may connect with level shifter 110 at collector 211 of level shifter transistor 111 and gate 220 of disconnect transistor 121. A 150 kΩ resistor 122 may be connected in parallel between gate 220 and source 222 of disconnect transistor 121. Source 222 of disconnect transistor 121 may be connected to the negative of battery 30.

LED cluster 130 may consist of multiple LEDs connected in series with a resistor with multiple strings connected in parallel. According to an aspect of the present invention, there may be four LEDs 131, 132, 133, and 134 connected in series with a 10 Ω resistor 135. The anode of first LED 131 may be connected to switch 12. Resistor 135 may be connected to drain 221 of disconnect transistor 121. There may be four strings of LEDs and resistors connected in this configuration (131-150).

Power control circuit 50 may terminate power to LED cluster 130 and external load 60 when base 200 of shutdown transistor 106 receives about 0.65 V or less. This shutdown voltage level may be determined by the voltage divider of resistor 102 and resistor 103 in parallel with battery 30. At this level, the shutdown transistor 106 may no longer allow current to flow from collector 200 to emitter 201 on shutdown transistor 106. The lack of power flowing through shutdown transistor 106 may change the voltage at collector 202 from zero to a positive charge. This change of charge at collector 106 on the shutdown transistor 106 may activate base 210 of level shifter transistor 111. Before base 210 of level shifter transistor 111 was activated, level shifter 111 allowed current to flow from emitter 212 to collector (211, keeping a positive charge to gate 220 of disconnect transistor 121. A positive charge at gate 220 may allow current to flow from source 222 to drain 221 of disconnect transistor 121, supplying power to LED cluster 130 and external load 60. The lack of power flowing into collector 212 of level shifter transistor 111 may change the voltage at gate 220 of disconnect transistor 121 to zero. When gate 220 of disconnect transistor 121 has no voltage, disconnect transistor 121 may be switched, terminating power to LED cluster 130 and external load 60. Changing the voltage at gate 220 to zero may change drain 221 of disconnect transistor 121 from zero to a positive charge. A positive charge at drain 221 of disconnect transistor 121 may cause the voltage divider of resistor 102 and resistor 103 to level shift to a positive charge and disconnect the voltage divider from battery 30. When LED cluster 130 and external load 60 is disconnected from battery 30, the voltage across battery 30 may increase. With voltage divider of resistor 102 and resistor 103 disconnected from battery 30, power control circuit 50 may keep the power terminated to LED cluster 130 and external load 60 until power control circuit 50 is reset.

Power control circuit 50 may be reset by inserting plug 42 into socket 32. Power from solar panel 40 across the voltage divider of resistor 102 and 103 may apply a voltage at base 200 of shutdown transistor 106 above 0.65 V. This voltage at base 200 may allow current to flow from collector 202 to emitter 201 of shutdown transistor 106. Having power flow through shutdown transistor 106 may change the voltage at collector 202 from a positive charge to zero. This change in charge at collector 202 of shutdown transistor 106 may lower the voltage at base 210 of level shifter transistor 111. Lowering the voltage at base 210 may allow current to flow from emitter 212 to collector 211 of level shifter transistor 111, changing the voltage at collector 211 from zero to a positive charge. A positive charge on collector 211 of level shifter transistor 111 may apply a positive charge to gate 220 of disconnect transistor 121. A positive charge at gate 220 may allow current to flow from source 222 to drain 221 of disconnect transistor 121 to recharge battery 30 and supply power from solar panel 40 to LED cluster 130 and external load 60.

Figure 4:
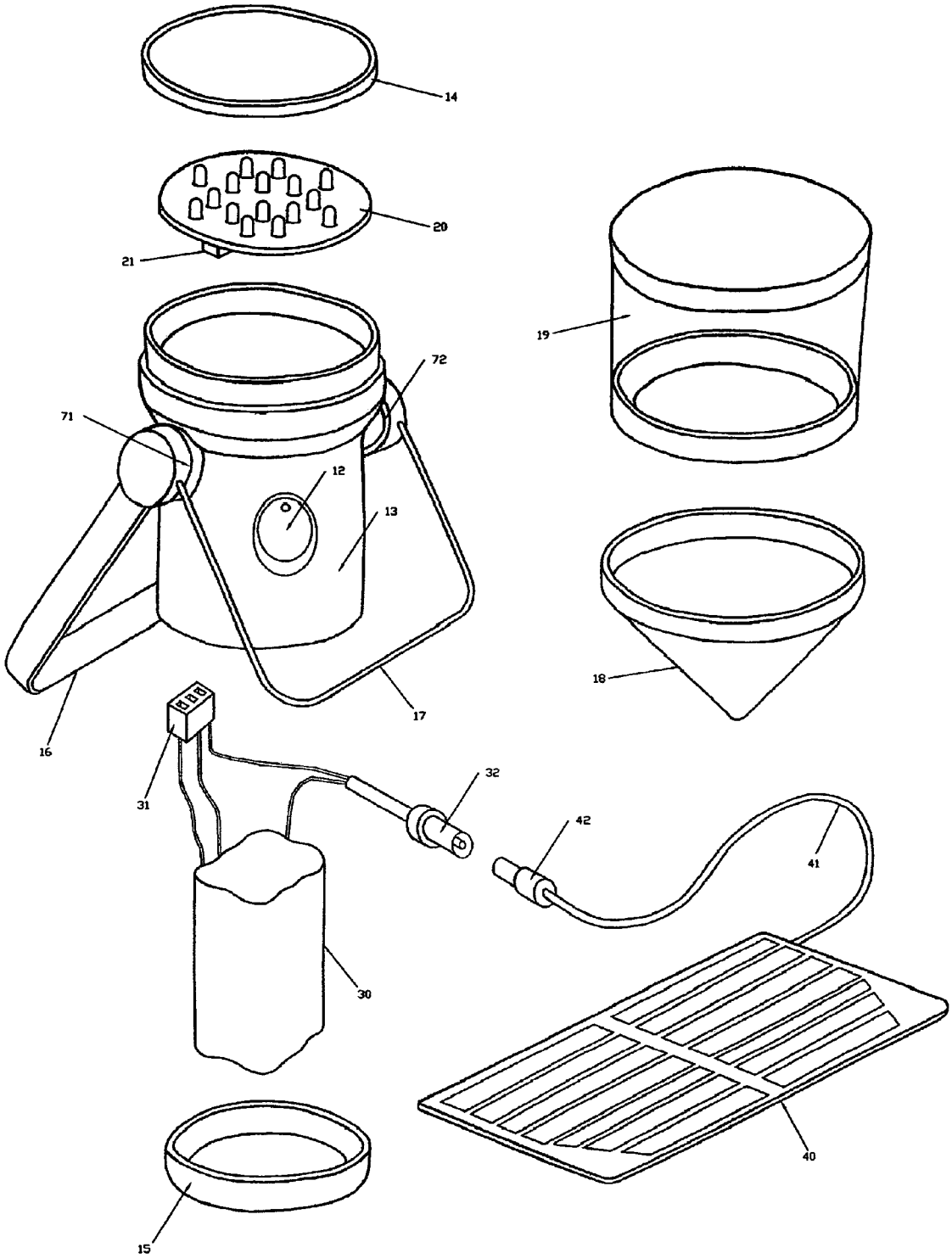
FIG. 4 illustrates a perspective exploded view of the lantern according to an aspect of the present invention.

Referring now to FIG. 4, there is shown a perspective exploded view of the lantern according to an aspect of the present invention. As may be seen in FIG. 4, a lantern assembly 1 may include a lantern 10, a housing 13, a cap 14, a base 15, a carrying handle 16, a stand 17, a circuit board 20, a battery 30, a connector 31, and a socket 32. Lantern assembly 1 may further include a solar panel 40, a cord 41, and a plug 42. Connector 31 may provide a means for releasably connecting battery 30 and socket 32 to circuit board 20. Circuit board 20 may be coupled between housing 13 and cap 14. Connector 31 may releasably connect to circuit board 20 inside housing 13.

Circuit board 20 may have a variety of dimensions and may be of any size, shape, thickness, or material, depending on the desired durability and cost of lantern 10. There may be a plurality of circuit boards 20. LED cluster 130 may be directly attached to circuit board 20, or it may be mounted on another component. Circuit board 20 may be coupled to cap 14 and housing 13 in a way including, but not limited to, snap-together, screw-on, individual screws, and rivets.

Connector 31 may be mounted within housing 13 to allow for releasably connecting circuit board 20 to battery 30, solar panel 30, external load 60, or any combination of these components. Connector 31 may be of any size, shape, or material, depending on the size, shape, or material of circuit board 20. A plurality of connectors 31 may be provided to allow for the provision of power to a plurality of circuit boards 20. The discussion herein and the associated figures focus the discussion on one connector for simplicity while knowing that multiple connectors may be used. Connector 31 may be located at any position within housing 13, within base 15, or within cap 14, depending upon the available space inside lantern 10 to connect circuit board 20 to other internal components.

Figure 5:
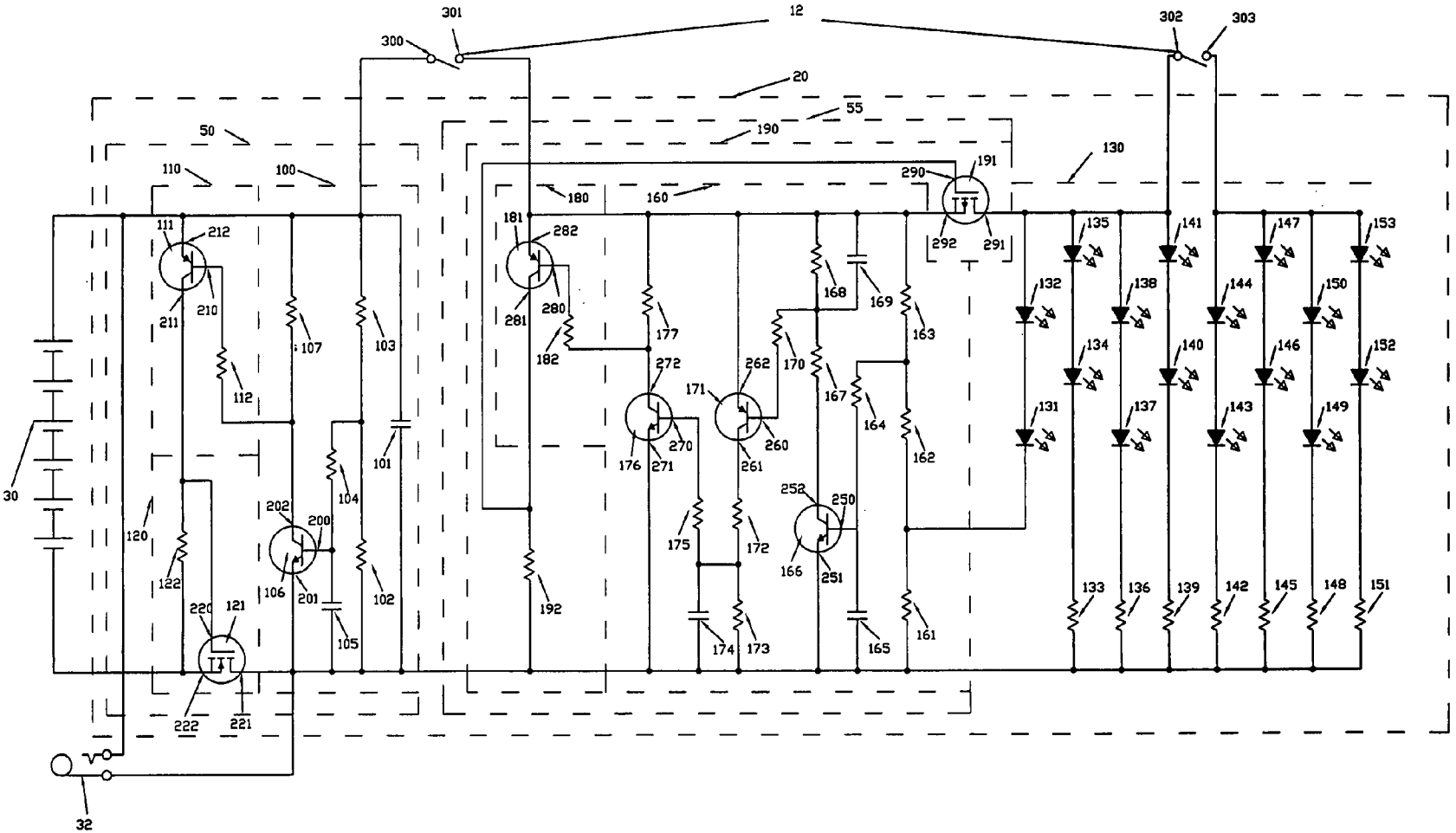
FIG. 5 illustrates a schematic circuit diagram of the power control circuit of the lantern according to an aspect of the present invention.

Referring now also to FIG. 5, there is shown a schematic circuit diagram of the power control circuit of the lantern according to an aspect of the present invention. As may be seen in FIG. 5, partially resembling the diagram of FIG. 3. As may be evident to those possessing an ordinary skill in the pertinent art, FIG. 5 represents an aspect of the present invention lowering the power consumption from 1.5 watts, as with the circuit shown in FIG. 3, to 1.3 watts.

According to an aspect of the present invention, 10 cells may be utilized with 4 LEDs per string providing 2.5 cells per LED which is approximately 3 volts per LED. Also 6 cells may be utilized with 2 LEDs per string providing 3 cells per LED which is approximately 3.6 volts per LED. According to an aspect of the present invention, the voltage may be modulated to give more consistent light output throughout the entire discharge of the battery and better light towards the end of battery discharge.

Housing 13 houses circuit board 20. Circuit board 20 consists of power control circuit 50, LED driver circuit 55, and LED cluster 130, schematically shown in FIG. 2. interfaces with switch 12, battery 30, and socket 32. Power control circuit 50 may be divided into three functional parts: shutdown 100, level shifter 110, and disconnect 120. Power control circuit 50 may allow battery 30 to discharge until the battery reaches approximately 5% state of charge (SOC) or 95% depth of discharge (DOD). Output power control circuit 50 may terminate the power to LED cluster 130 and/or external load 60 to prevent battery 30 from degrading.

Shutdown 100 may control when power output is terminated. Shutdown 100 may contain a 24.9 k Ω resistor 102 in series with a 280 k Ω resistor 103. The level of resistance in these two resistors determines at what voltage should the power output is terminated. Resistors 102 and 103 may be configured in a voltage divider configuration. The values of the resistors will be selected depending on the desired cut-off voltage. A 0.1 μF capacitor 101 connected in parallel with the voltage divider resistors 102 and 103. Interconnected between resistors 102 and 103 is a 100 k Ω resistor 104 leading to the base terminal 200 of the NPN shutdown transistor 106. Emitter terminal 201 of shutdown transistor 106 may be connected to drain 221 on disconnect transistor 121. Disconnect transistor 121 may take the form of a metal-oxide semiconductor field-effect transistor (MOSFET). A 0.1 μF capacitor 105 connected in parallel between base terminal 200 of shutdown transistor 106 and drain 221 on disconnect MOSFET 121. A 750 k Ω resistor 107 is connected between the collector terminal 202 of shutdown transistor 106 and the positive of battery 30. Shutdown 100 may control level shifter 110.

Level shifter 110 may connect with shutdown 100 by a 100 k Ω resistor 112 to collector terminal 202 of shutdown transistor 106 and base terminal 210 of PNP level shifter transistor 111. Emitter 212 of level shifter transistor 111 may be connected to the positive of battery 30. Level shifter 110 may be controlled by shutdown 100, and in turn level shifter 110 may control disconnect 120.

Disconnect 120 may connect with level shifter 110 at collector 211 of level shifter transistor 111 and gate 220 of disconnect MOSFET 121 connection. A 150 k Ω resistor may be connected in parallel between gate 220 and source 222 of transistor 121. Source 222 of disconnect MOSFET 121 may be connected to the negative of battery 30.

LED driver circuit 55 may also be divided into three functional parts: modulator 160, shifter 180, and switch 190. LED drive circuit may modulate the LEDs to produce a consistent light output in the range of approximately 5000-5500 Lux, for example, during the entire discharge profile of the battery. The light output may also be designed to be in the range of 3000-8000 Lux.

Modulator 160 may control the rate of modulation of LED cluster 130. Modulator 160 may consist of a 10.5 Ω resistor 161 connected in series with a 10.0K Ω resistor 162 and a 182K Ω resistor 163. Interconnected between resistors 162 and 163 is a 2.2 k Ω resistor 164 leading to base terminal 250 of NPN transistor 166. Emitter terminal 251 of NPN transistor 166 is connected to drain 221 on the disconnect of MOSFET 121. A 0.1 μF capacitor 165 connected in parallel between base terminal 250 of NPN transistor 166 and drain 221 on disconnect MOSFET 121. A 56 k Ω resistor is connected between the collector terminal 252 of the NPN transistor 166 and a 7.5 k Ω resistor 168. The other end of resistor 168 may be connected to source 292 of switch MOSFET 191. In parallel with resistor 168 is a 47 nF capacitor 169. Interconnected between resistors 167 and 168 is a 2.2 k Ω resistor 170 leading to base terminal 260 of PNP transistor 171. Emitter terminal 162 of PNP transistor 171 may be connected to source 292 on switch MOSFET 191. Connected to collector 261 of PNP transistor 171 may be a 19.1 k Ω resistor 172 and a 2.37 k Ω resistor 173 connected in series. The other end of resistor 173 is may be connected to drain 221 of disconnect MOSFET 121. In parallel with resistor 173 may be a 47 nF capacitor 174. Interconnected between resistor 172 and 173 may be a 2.2 k Ω resistor 175 leading to base terminal 270 of NPN transistor 176. Emitter terminal 271 of NPN transistor 176 may connected to the drain 221 on disconnect MOSFET 121. A 100 k Ω resistor 177 may be connected between collector 272 of NPN transistor 176 and source 292 on switch MOSFET 191.

Shifter 180 may be connected to modulator 160 by a 22 k Ω resistor 182 connected between collector 272 of NPN transistor 176 of modulator 160 and base 280 of PNP transistor 181 of shifter 180. Emitter 282 of PNP transistor 181 may be connected to source 292 on switch MOSFET 191.

Switch 190 may be connected to shifter 180 by collector 281 of PNP transistor 181 of shifter 180 being connected to gate 290 of switch MOSFET 191. Also, there may be a 22 k Ω resistor 192 connected between the gate 290 of the switch MOSFET 191 and drain 221 of disconnect MOSFET 121.

LED cluster 130 may consist of any bright LEDs with multiple LEDs connected in series with a resistor with multiple strings connected in parallel. This configuration is of a conventional design generally known to those skilled in the art. According to an aspect of the present invention, there may be two LEDs 131, 132 connected in series with cathode of LED 132 connected between resistor 161 and resistor 162 of modulator 160. The anode of the first LED 132 may be connected to drain 291 of switch MOSFET 191. According to an aspect of the present invention, there may be eight more strings of two LEDs and a resistor connected in series between drain 291 of switch MOSFET 191 and drain 221 on disconnect MOSFET 121 with each resistor of substantially equivalent resistance as resistor 161.

When battery 30 is charged, power control circuit 50 may allow power to flow to LED cluster 130 or external load 60. Power control circuit 50 may allow battery 30 to discharge until the battery reaches approximately a 5% state of charge (SOC) or 95% depth of discharge (DOD). Output power control circuit 50 may terminate the power to LED cluster 130 and/or external load 60 to prevent battery 30 from degrading.

Power termination may occur when base 200 of shutdown transistor 106 receives about 0.65 V or less. This specified level may be determined by the voltage divider of resistor 102 and resistor 103 in parallel with battery 30. At this level the shutdown transistor 106 no longer allows current to flow from collector 202 to emitter 201 on shutdown transistor 106. The lack of power flowing through shutdown transistor 106 changes the voltage at its collector 202 from zero to a positive charge. This change of charge at collector 106 on shutdown transistor 106 activates base 210 of level shifter transistor 111. Prior to activation of base 210 of level shifter transistor 111, level shifter transistor 111 allowed current to flow from emitter 212 to collector 211 keeping a positive charge to gate 220 of disconnect MOSFET 121. A positive charge at gate 220 allows current to flow from source 222 to drain 221 of disconnect MOSFET 121 supplying power to light 130 and\or external load 60. The lack of power flowing into collector 211 of level shifter transistor 111 may change the voltage at gate 220 of disconnect MOSFET 121 to zero. When gate 220 of disconnect MOSFET 121 has no voltage, the MOSFET is switched, terminating power to light 130 and/or external load 60. Changing the voltage at gate 220 to zero may change drain 221 of disconnect MOSFET 121 voltage from zero to a positive charge. A positive charge at drain 221 of disconnect MOSFET 121 may cause the voltage divider of resistor 102 and resistor 103 to level shift to a positive charge and may disconnect voltage divider from battery 30. When LED cluster 130 and/or external load 60 is disconnected from the battery 30, the voltage across battery 30 increases. With the voltage divider of resistor 102 and resistor 103 disconnected from the battery 30, power control circuit 50 may keep the power terminated to LED cluster 130 and/or external load 60 until power control circuit 50 is reset.

Resetting power control circuit 50 may be accomplished by inserting plug 42 of solar panel 40 into socket 32 of lantern 10. Power from solar panel 40 across the voltage divider of resistor 102 and 103 applies a voltage at the base 200 of shutdown transistor 106 above 0.65 V. This voltage at base 200 allows current to flow from collector 202 to emitter 201 of shutdown transistor 106. Having power flow through shutdown transistor 106 may change its collector 202 voltage from a positive charge to zero. This change in charge at collector 202 of shutdown transistor 106 lowers the voltage at base 210 of level shifter transistor 111. Lowering the voltage at base 210 allows current to flow from emitter 210 to collector 211 of level shifter transistor 111 changing the voltage at collector 211 from zero to a positive charge. A positive charge on collector 211 of the level shifter transistor applies a positive charge to gate 220 of disconnect MOSFET 121. A positive charge at gate 220 may allow current to flow from source 222 to drain 220 of disconnect MOSFET 121 to recharge battery 30 and supply power from solar panel 40 to LED cluster 130 and\or external load 60.

When switch 12 is closed to a first position, current may flow through LEDs 132,133, and resistor 161 turning on LEDs 132,133, and resistor 161 turning on LEDs (132-141) of LED cluster 130. This may cause the lantern to emit light 180° radially in the lantern mode and one-half intensity in the flashlight mode, by way of non-limiting example only. This may cause a voltage at base 250 of modulation transistor 166 to increase allowing current to flow from collector 252 to emitter 251 of modulation transistor 166. Resistor 168 discharges through capacitor 169 causing the voltage at base 260 of modulation transistor 171 to decrease. As the base 260 voltage decreases, current may flow from emitter 262 to collector 261 of modulation transistor 171. This current charges capacitor 174 and increases the voltage at base 270 of modulation transistor 176. Increasing the voltage at base 271 of modulation transistor 176, may allow current to flow from collector 272 to emitter 271 of modulation transistor and through resistor 177. Current through resistor 177 decreases the voltage at base 280 of shifter transistor 181. Decreasing the voltage at base 280 in turn allows current to flow from emitter 282 to collector 281 of shifter transistor 181 changing the voltage at collector 281 from zero to a positive charge. A positive charge on collector 281 of shifter transistor applies a positive charge to gate 290 of switch MOSFET 191. A positive charge at gate 290 disconnects current to flow from source 292 to drain 291 of switch MOSFET 191. Switching the current flow off through switch MOSFET 191 turns off LED cluster 130 and the current flow through resistor 161. This causes a voltage at base 250 of modulation transistor 166 to decrease thereby interrupting current flow from collector 252 to emitter 251 of modulation transistor 166. Resistor 168 recharges through capacitor 169 causing the voltage at base 260 of modulation transistor 171 to increase. As base 260 voltage increases, current flow is interrupted from emitter 262 to collector 261 of modulation transistor 171. This causes capacitor 174 to discharge through resistor 173 decreasing the voltage at the base 270 of the modulation transistor 176. Lowering the voltage at base 270 of modulation transistor 176 interrupts current flow from collector 272 to emitter 271 of modulation transistor and through resistor 177. With no current through resistor 177, the voltage at base 280 of shifter transistor 181 is increased. Increasing the voltage at the base 280 interrupts current flow through emitter 282 to collector 281 of shifter transistor 181 changing the voltage at collector 281 from positive to zero. A zero charge on collector 281 of shifter transistor applies zero charge to gate 290 of switch MOSFET 191. A zero charge at gate 290, in turn, allows current to flow from source 292 to drain 291 of switch MOSFET 191. Switching the current flow back on through switch MOSFET 191 turns LED cluster 130 back on and reestablishes current flow through resistor 161. When switch 12 is in a second position that is closed, LEDs 144-153 of LED cluster 130 are connected to the LED driver circuit 55 emitting light 360° radially in the lantern mode and full intensity in the flashlight mode.

When battery 30 is fully charged, modulator 190 may oscillate LED cluster 130 at frequency and duty cycle to produce the desired light output from LED cluster 130. According to an aspect of the present invention, the starting frequency is about 3 kHz with a duty cycle of about 40 percent with a desired light output of about 5,500 Lux. As the battery voltage drops during discharge, the frequency of modulation decreases and the duty cycle increases keeping LED cluster 130 on longer to maintain the desired light output. When the voltage on battery 30 is lower such that the desired light output is produced without modulating LED cluster 130, the frequency of modulation of modulator 190 is zero and LED cluster 130 is continuously on. This set point is determined by the voltage divider of resistor 163 with resistors 162 and 161 with the added voltage from the current through LEDs 131, 132 and resistor 161. According to an aspect of the present invention, the voltage on battery 30 is 6.25 volts.

Those of ordinary skill in the art may recognize that many modifications and variations of the present invention may be implemented without departing from the spirit or scope of the invention. Thus, it is intended that the present invention covers the modifications and variations of this invention provided they come within the scope of the appended claims and their equivalents.

The invention claimed is:

1. A solar rechargeable lantern assembly, comprising:

at least one light source;

a battery;

a power control circuit for electrically coupling the battery to said at least one light source;

a solar panel; and an electrical connector, coupled to the power control circuit, for releasably connecting at least one of the solar panel and an external load to the power control circuit;

wherein said power control circuit comprises a switch for interrupting power supplied by the battery when the battery reaches a low voltage threshold, and wherein said switch is reset by application of power to the power control circuit in response to connection of the solar panel to the electrical connector to allow power to flow to the battery and to at least one of the light source and the external load during a recharging cycle.

2. The assembly of claim 1, wherein said light source is an LED cluster.

3. The assembly of claim 1, wherein said solar panel is suitable for directly providing power to said light source.

4. The assembly of claim 1, wherein said battery is a rechargeable battery.

5. The assembly of claim 1, wherein said battery is a nickel-metal hydride battery.

6. The assembly of claim 1, wherein said battery is a cadmium battery.

7. The assembly of claim 1, wherein said lantern assembly contains a carrying handle.

8. The assembly of claim 1, wherein said lantern assembly contains a stand to allow for increased stability.

9. The assembly of claim 1, wherein said switch prevents said battery from being drawn below a 5% state of charge threshold.

10. The solar rechargeable lantern assembly of claim 1, wherein said switch includes at least one transistor.

11. The solar rechargeable lantern assembly of claim 1, further comprising a reflector.

12. The solar rechargeable lantern assembly of claim 11, wherein said reflector comprises a conical shape.

13. The solar rechargeable lantern assembly of claim 12, wherein said conical shape reflector reflects using at least a portion of the outside surface of the cone of said conical shape.

14. The solar rechargeable lantern assembly of claim 11, wherein removing said reflector configures the lantern to radiate light axially.

15. A method of operating a solar rechargeable lantern assembly which comprises at least one light source, a battery, a power control circuit for electrically coupling the battery to said at least one light source, a solar panel, and an electrical connector, coupled to the power control circuit, for releasably connecting at least one of the solar panel and an external load to the power control circuit, comprising the steps of:

a) interrupting power supplied by the battery when the battery reaches a low voltage threshold by means of a switch in the power control circuit, and b) resetting said switch by application of power to the power control circuit in response to connection of the solar panel to the electrical connector to allow power to flow to the battery and to at least one of the light source and the external load during a recharging cycle.

16. The method of claim 15, wherein said solar panel provides power to said lantern assembly.

17. The method of claim 15, wherein said switch prevents said battery from being drawn below a 5% state of charge threshold.

18. The method of claim 15, wherein said solar panel is suitable for directly providing power to said light source.

19. The method of claim 15, wherein said light source is an LED cluster.

* * * * *